US011696658B2

(12) United States Patent
Zhou

(10) Patent No.: US 11,696,658 B2
(45) Date of Patent: Jul. 11, 2023

(54) LEAKAGE-PROOF CUP

(71) Applicant: Ningbo Hailan Plastic Co., Ltd., Ningbo (CN)

(72) Inventor: Shuibing Zhou, Ningbo (CN)

(73) Assignee: NINGBO HAILAN PLASTIC CO., LTD, Ningbo (CN)

( * ) Notice: Subject to any disclaimer, the term of this patent is extended or adjusted under 35 U.S.C. 154(b) by 179 days.

(21) Appl. No.: 17/320,420

(22) Filed: May 14, 2021

(65) Prior Publication Data

US 2021/0361098 A1 Nov. 25, 2021

(30) Foreign Application Priority Data

May 22, 2020 (CN) ..... 202020885701.9

(51) Int. Cl.
*A47G 19/22* (2006.01)

(52) U.S. Cl.
CPC ..... *A47G 19/2272* (2013.01)

(58) Field of Classification Search
CPC ..... A47G 19/2222; A47G 19/2266; A47G 19/2272
USPC ..... 220/229, 703, 705, 709, 790–791, 801; 215/320, 321, 355; 222/494
See application file for complete search history.

(56) References Cited

U.S. PATENT DOCUMENTS

| | | | | |
|---|---|---|---|---|
| D781,653 | S | 3/2017 | Matthis et al. | |
| D804,907 | S | 12/2017 | Sandoval | |
| D873,603 | S | 1/2020 | Diener et al. | |
| D891,866 | S | 8/2020 | Ames | |
| 2014/0069944 | A1* | 3/2014 | Shapiro | A61J 9/006 220/709 |
| 2015/0102029 | A1* | 4/2015 | Bargiel | A47G 19/2272 220/709 |
| 2016/0286992 | A1* | 10/2016 | Sladics | A47G 19/2222 |
| 2019/0375559 | A1* | 12/2019 | Spivey | B65D 43/0229 |

* cited by examiner

*Primary Examiner* — James N Smalley
*Assistant Examiner* — Madison L Poos
(74) *Attorney, Agent, or Firm* — Ostrager Chong Flaherty & Broitman P.C.

(57) ABSTRACT

A leakage-proof cup with a cup body and a cup cover has an insertion hole penetrating through the cup cover, a sealing element made of an elastic material detachably connected in the insertion hole, and a notch for a straw to be inserted into the cup body formed in the sealing element. The outer edge of the lower end of the sealing element is provided with a flange annularly distributed along the sealing element and extending in a radial direction. The insertion hole is provided with a first step matched with the flange. When the sealing element is connected to the insertion hole, the flange is abutted against the first step. When the straw is taken out of the insertion hole, the sealing element is reset under the elastic force of the sealing element and closes the notch so the water in the cup cannot be spilled out.

6 Claims, 5 Drawing Sheets

LEAKAGE-PROOF CUP

TECHNICAL FIELD

The utility model relates to the technical field of cups, and particularly relates to a leakage-proof cup.

BACKGROUND

The cup is a daily article that can be seen everywhere in our life. The traditional cup includes a cup cover and a cup body. When drinking water, the cup cover is opened, and when the cup is not used, the cup cover is tightened on the cup body. However, this cup has a large caliber and is not suitable for children to use. The existing cup suitable for the children to use is usually provided with an insertion hole in the cup cover and a straw is arranged in the insertion hole to facilitate the children to absorb water from the straw. However, this cup is easy to leak when inclined or accidentally overturned. Especially when the cup is carried outside, the water in the cup may leak from the insertion hole of the straw because the cup is inclined, thereby wetting or polluting other articles in the bag and causing unnecessary loss.

In order to prevent this condition, a leakage-proof pad is generally fixed at the insertion hole through a fixing element and a notch is arranged on the leakage-proof pad. For example, refer to the disclosure of the utility model with publication No. CN210446525U and title of a leakage-proof sealed cup cover. Because the leakage-proof pad is reset under the action of the elastic force of the leakage-proof pad and closes the notch when the straw is taken out of the insertion hole, water in the cup cannot be spilled out from the insertion hole. However, the components in the device are small and numerous, and troublesome to assemble. The assembly cost is increased. If the fixing element is not tightly screwed, the water in the cup can also leak from the seam of the leakage-proof pad and the insertion hole.

SUMMARY

A technical problem to be solved in the utility model is to overcome the defects of the prior art to provide a leakage-proof cup with simple structure, convenient installation, and good sealing performance.

A technical solution of the utility model is: a leakage-proof cup with the following structure is provided: the leakage-proof cup comprises a cup body and a cup cover matched and connected hermetically with the cup body, wherein an insertion hole penetrating through the cup cover is formed in the cup cover; a sealing element made of an elastic material is detachably connected in the insertion hole; a notch for a straw to be inserted into the cup body is formed in the sealing element; the outer edge of the lower end of the sealing element is provided with a flange which is annularly distributed along the sealing element and extends in a radial direction; and the insertion hole is provided with a first step matched with the flange. When the sealing element is connected to the insertion hole, the flange is abutted against the first step.

After the above structure is adopted, compared with the prior art, the leakage-proof cup of the utility model has the following advantages:

The sealing member made of the elastic material is detachably connected in the insertion hole, and the notch for the straw to be inserted into the cup body is arranged in the sealing member. When the straw is inserted into the cup body from the insertion hole, the straw overcomes the elastic force of the sealing member and penetrates through the notch. When the straw is taken out of the insertion hole, the sealing element is reset under the action of the elastic force of the sealing element and closes the notch. In this way, water in the cup cannot be spilled out. The flange which extends in the radial direction is arranged on the outer edge of the lower end of the sealing element, and the first step matched with the flange is arranged on the insertion hole. Through cooperation of the flange and the first step, sealing connection between the sealing element and the insertion hole can be guaranteed. During installation, the sealing element only needs to be inserted into the insertion hole so that the flange is located on the first step. The installation is simple and convenient, and the water leakage phenomenon can be avoided.

Preferably, the lower end of the flange is arranged as a conical surface with smaller bottom and larger top. In this way, the sealing element is conveniently inserted into the insertion hole.

Preferably, the outer edge of the top end of the sealing element is provided with a convex edge which is annularly distributed along the sealing element and extends in the radial direction; and the insertion hole is provided with a counterbore matched with the convex edge. When the sealing element is connected to the insertion hole, the convex edge is located in the counterbore. The arrangement can prevent the sealing element from being inserted too deeply and falling into the cup body and can also guarantee the sealing connection between the sealing element and the insertion hole.

Preferably, the sealing element is also provided with an annular lug boss; the insertion hole is provided with a second step matched with the annular lug boss; and the outer diameter size of the annular lug boss is less than the outer diameter size of the flange. Through cooperation of the annular lug boss and the second step, sealing performance between the sealing element and the insertion hole is enhanced.

Preferably, the notch is a crossed notch arranged in the central position of the sealing element; when the straw is inserted into the cup body from the insertion hole, the straw overcomes the elastic force of the sealing element and penetrates through the crossed notch; and when the straw is taken out of the insertion hole, the sealing element is reset under the action of the elastic force of the sealing element and closes the crossed notch.

Preferably, an anti-slip structure is arranged on the outer side wall of the cup cover. The friction coefficient between the hand and the cup cover can be increased, which is convenient to tighten or open the cup cover.

Preferably, the anti-slip structure is an anti-slip pattern distributed circumferentially along the outer side wall of the cup cover. The anti-slip pattern that extends linearly is arranged on the outer circumferential wall of the cup cover to increase the friction coefficient between the hand and the cup cover, which is convenient for a user to tighten or open the cup cover.

Figure 1:
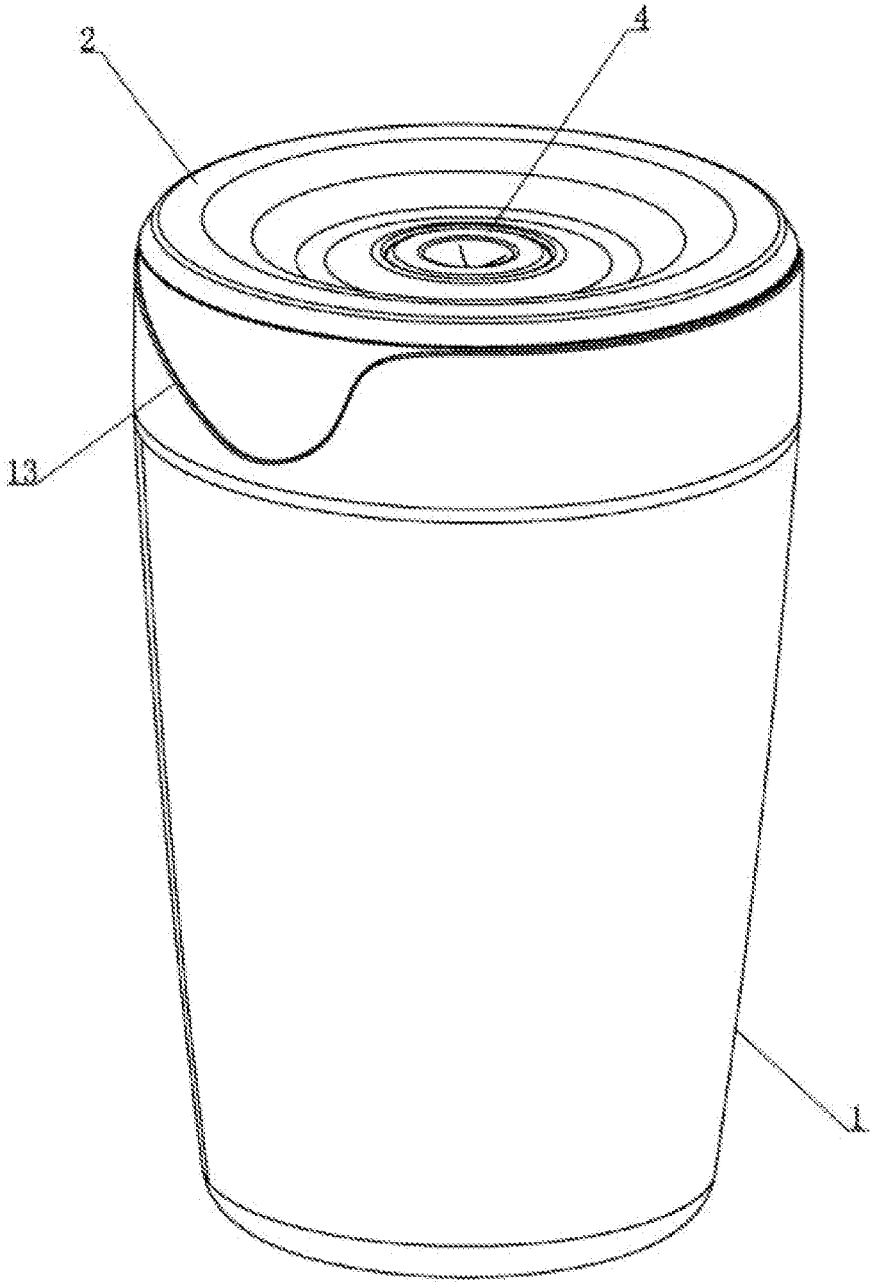
FIG. 1 is a structural schematic diagram of the utility model.
Figure 2:
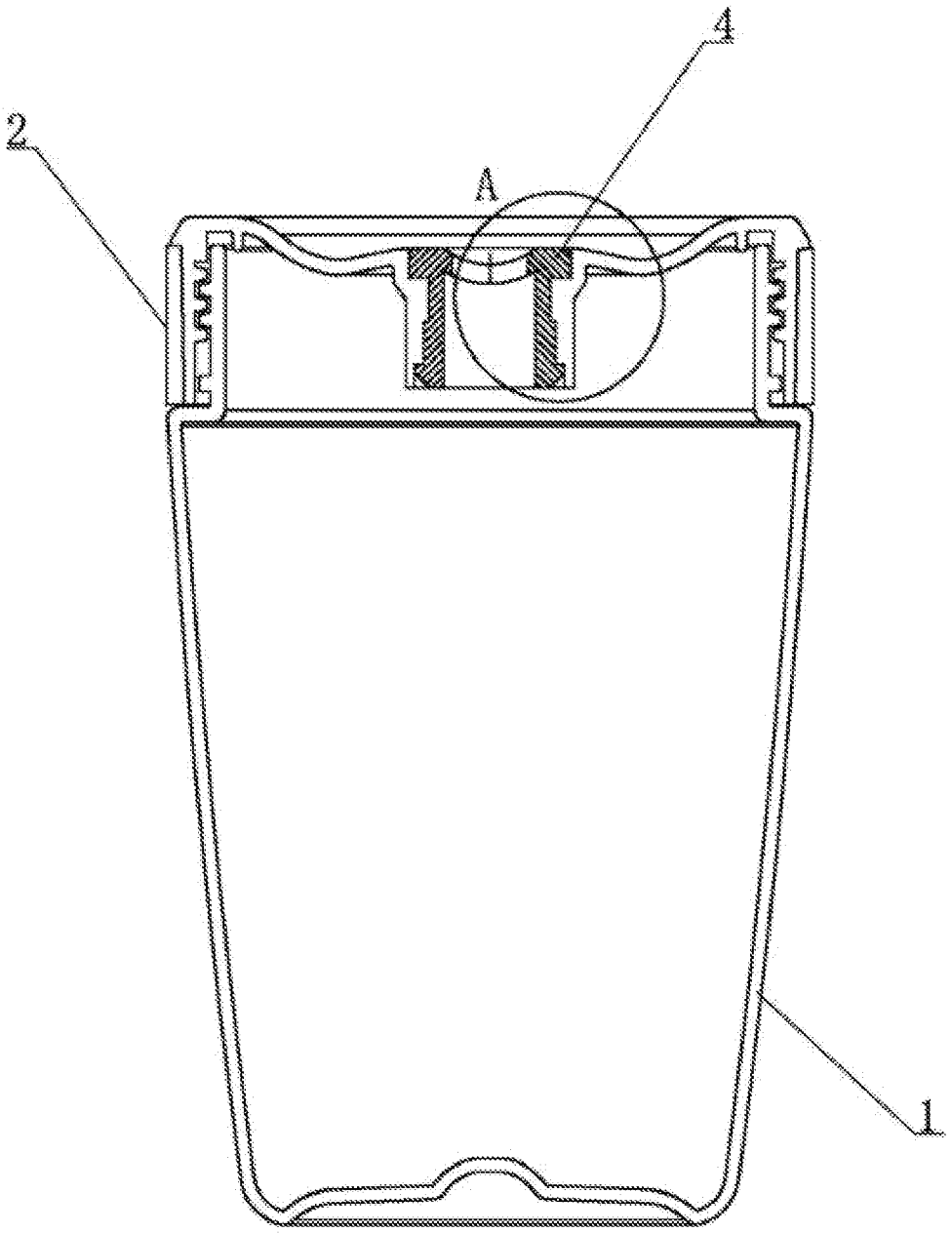
FIG. 2 is a sectional structural schematic diagram of the utility model.
Figure 3:
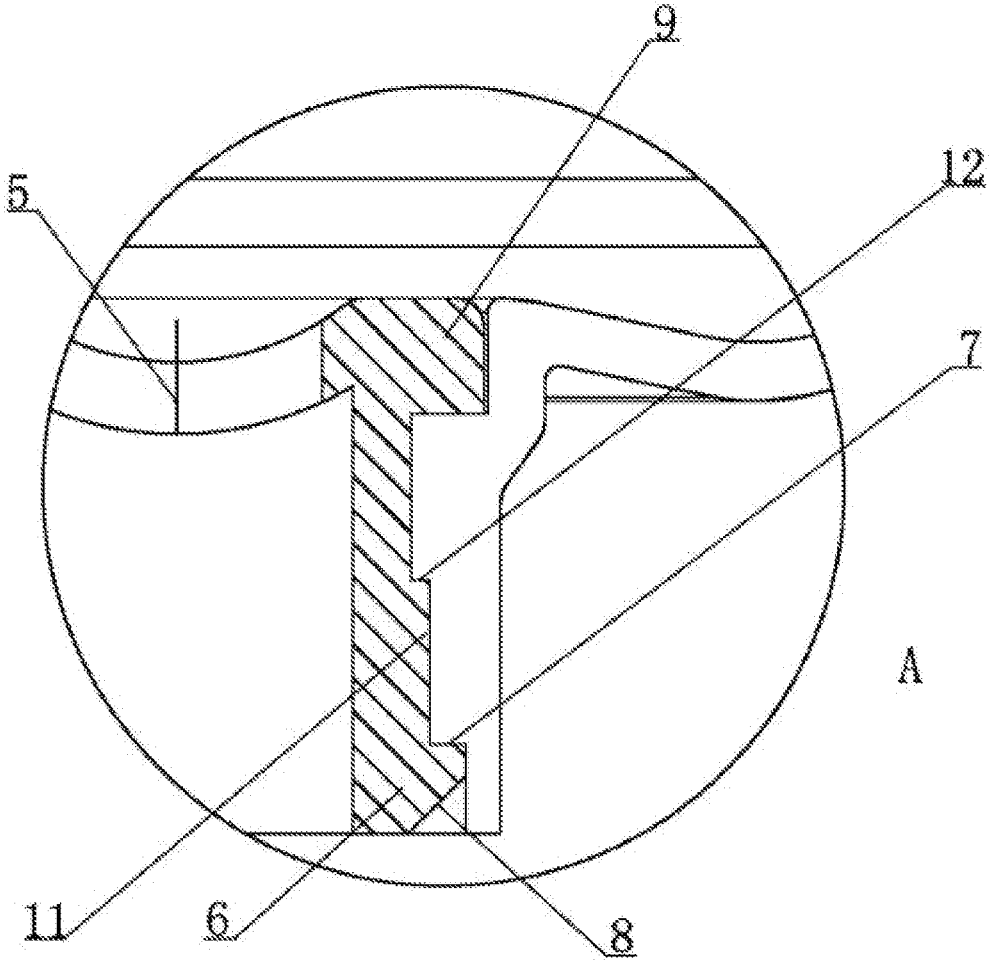
FIG. 3 is an enlarged view of A part of FIG. 2.

As shown in the figures: 1 cup body; 2 cup cover; 3 insertion hole; 4 sealing element; 5 notch; 6 flange; 7 first step; 8 conical surface; 9 convex edge; 10 counterbore; 11 annular lug boss; 12 second step; and 13 anti-slip structure.

DETAILED DESCRIPTION

The utility model is further described below in detail in combination with the drawings and specific embodiments.

It should be understood in the description of the utility model that terms such as "upper", "lower", "front", "rear", "left", "right", "vertical", "horizontal", "top", "bottom", "inner" and "outer" indicate direction or position relationships shown based on the drawings, and are only intended to facilitate the description of the utility model and the simplification of the description rather than to indicate or imply that the indicated device or element must have a specific direction or constructed and operated in a specific direction, and therefore, shall not be understood as a limitation to the utility model. At the same time, the terms such as "first" and "second" are only used to distinguish the names of the components and have no primary and secondary relationship, and thus shall not be understood as a limitation to the utility model.

As shown in FIG. 1, FIG. 2, FIG. 3, FIG. 4, and FIG. 5:

The utility model discloses a leakage-proof cup with the following structure: the leakage-proof cup comprises a cup body 1 and a cup cover 2 matched and connected with the cup body 1 by threads. An insertion hole 3 penetrating through the cup cover 2 is formed in the cup cover 2; a sealing element 4 (such as silica gel sealing element) made of an elastic material is detachably connected in the insertion hole 3; and a notch 5 for a straw to be inserted into the cup body 1 is formed in the sealing element 4. The notch 5 is a crossed notch 5 arranged in the central position of the sealing element 4; when the straw is inserted into the cup body 1 from the insertion hole 3, the straw overcomes the elastic force of the sealing element 4 and penetrates through the crossed notch 5; and when the straw is taken out of the insertion hole 3, the sealing element 4 is reset under the action of the elastic force of the sealing element and closes the crossed notch 5. The outer edge of the lower end of the sealing element 4 is provided with a flange 6 which is annularly distributed along the sealing element 4 and extends in a radial direction; and the lower end of the flange 6 is arranged as a conical surface 8 with smaller bottom and larger top. The insertion hole 3 is provided with a first step 7 matched with the flange 6. When the sealing element 4 is connected to the insertion hole 3, the flange 6 is abutted against the first step 7.

The sealing member 4 made of the elastic material is detachably connected in the insertion hole 3, and the notch 5 for the straw to be inserted into the cup body 1 is arranged in the sealing member 4. When the straw is inserted into the cup body 1 from the insertion hole 3, the straw overcomes the elastic force of the sealing member 4 and penetrates through the notch 5. When the straw is taken out of the insertion hole 3, the sealing element 4 is reset under the action of the elastic force of the sealing element and closes the notch 5. In this way, water in the cup cannot be spilled out. The flange 6 which extends in the radial direction is arranged on the outer edge of the lower end of the sealing element 4, and the first step 7 matched with the flange 6 is arranged on the insertion hole 3. Through cooperation of the flange 6 and the first step 7, sealing connection between the sealing element 4 and the insertion hole 3 can be guaranteed. The installation is simple and convenient, and the water leakage phenomenon can be avoided. Through the conical surface 8 on the lower end of the flange 6, the sealing element 4 can be conveniently inserted into the insertion hole 3.

As shown in FIG. 2, FIG. 3, FIG. 4 and FIG. 5, the outer edge of the top end of the sealing element 4 is provided with a convex edge 9 which is annularly distributed along the sealing element 4 and extends in the radial direction; and the insertion hole 3 is provided with a counterbore 10 matched with the convex edge 9. When the sealing element 4 is connected to the insertion hole 3, the convex edge 9 is located in the counterbore 10. The arrangement can prevent the sealing element 4 from being inserted too deeply and falling into the cup body 1, and can also guarantee the sealing connection between the sealing element 4 and the insertion hole 3.

The sealing element 4 is also provided with an annular lug boss 11; the insertion hole 3 is provided with a second step 12 matched with the annular lug boss 11; and the outer diameter size of the annular lug boss 11 is less than the outer diameter size of the flange 6. Through cooperation of the annular lug boss 11 and the second step 12, sealing performance between the sealing element 4 and the insertion hole 3 is enhanced.

Figure 4:
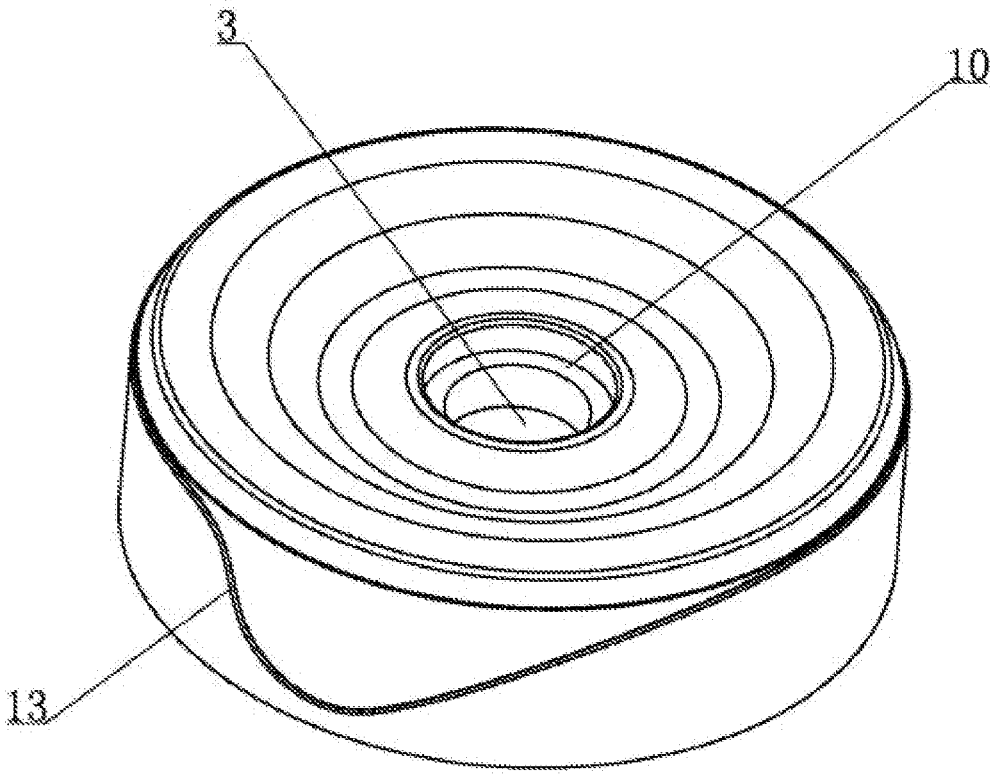
FIG. 4 is a structural schematic diagram of a cup cover of the utility model.
Figure 5:
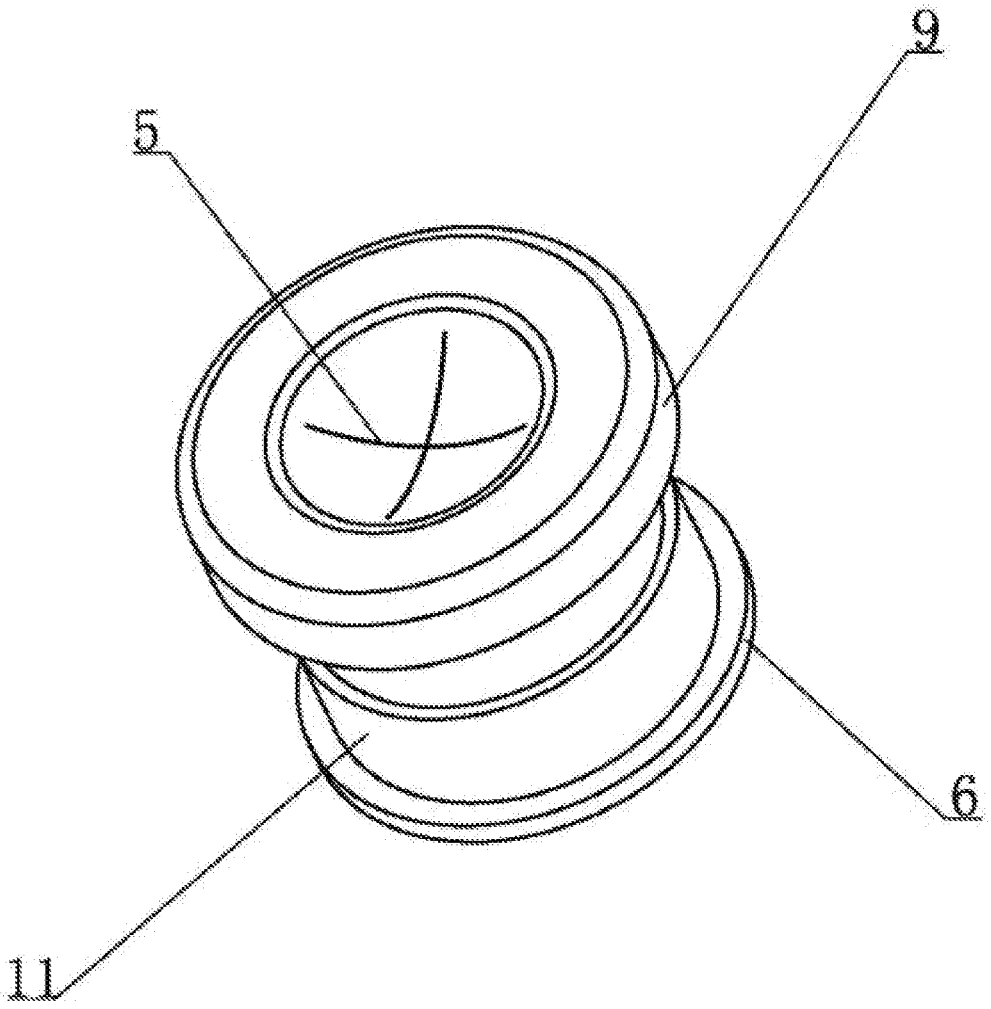
FIG. 5 is a structural schematic diagram of a sealing element of the utility model.

As shown in FIG. 1 and FIG. 4, an anti-slip structure 13 is arranged on the outer side wall of the cup cover 2. The anti-slip structure 13 is an anti-slip pattern distributed circumferentially along the outer side wall of the cup cover 2. The anti-slip pattern that extends linearly is arranged on the outer circumferential wall of the cup cover 2 to increase the friction coefficient between the hand and the cup cover 2, which is convenient for the user to tighten or open the cup cover 2.

The above only describes the specific embodiments of the utility model, but the protection scope of the utility model is not limited thereto. Any change or replacement contemplated easily by those skilled in the art familiar with the technical field within the technical scope disclosed by the utility model shall be covered within the protection scope of the utility model. Therefore, the protection scope of the utility model shall be determined by the protection scope of the claims.

I claim:

1. A leakage-proof cup, comprising a cup body (1) and a cup cover (2) matched and connected hermetically with the cup body (1), wherein an insertion hole (3) penetrating through the cup cover (2) is formed in the cup cover (2); a sealing element (4) made of an elastic material is detachably connected in the insertion hole (3); a notch (5) for a straw to be inserted into the cup body (1) is formed in the sealing element (4); an outer edge of the sealing element (4) is provided with a flange (6) at a lower end of the sealing element (4) and an annular lug boss (11) positioned above the flange (6), the annular log boss (11) having an outer diameter size less than the outer diameter size of the flange (6), the flange (6) and the annular lug boss (11) being annularly distributed along the sealing element (4) and extending in a radial direction; the insertion hole (3) is provided with a first step (7) in a sidewall of the insertion hole (3) that reduces an inner diameter of the insertion hole (3) and is matched with the flange (6) and a second step (12) in the sidewall of the insertion hole (3) that further reduces the inner diameter of the insertion hole (3) and is matched with the annular lug boss (11); and when the sealing element (4) is connected to the insertion hole (3), the flange (6) is abutted against the first step (7), the annular lug boss (11) is abutted against the second step (12) and a bottom surface of the flange (6) is aligned flush with a bottom surface of the insertion hole (3).

2. The leakage-proof cup according to claim 1, wherein the bottom surface of the flange (6) is arranged as a conical surface (8) to provide the flange (6) at the lower end of the sealing element (4) with smaller bottom and larger top.

3. The leakage-proof cup according to claim 1, wherein the outer edge of a top end of the sealing element (4) is provided with a convex edge (9) which is annularly distributed along the sealing element (4) and extends in a radial direction; the insertion hole (3) is provided with a counterbore (10) matched with the convex edge (9); and when the sealing element (4) is connected to the insertion hole (3), the convex edge (9) is located in the counterbore (10) and a top edge of the sealing element (4) is aligned flush with a top edge of the insertion hole (3).

4. The leakage-proof cup according to claim 1, wherein the notch (5) is a crossed notch (5) arranged in the central position of the sealing element (4); when the straw is inserted into the cup body (1) from the insertion hole (3), the straw overcomes the elastic force of the sealing element (4) and penetrates through the crossed notch (5); and when the straw is taken out of the insertion hole (3), the sealing element (4) is reset under the action of the elastic force of the sealing element and closes the crossed notch (5).

5. The leakage-proof cup according to claim 1, wherein an anti-slip structure (13) is arranged on the outer side wall of the cup cover (2).

6. The leakage-proof cup according to claim 5, wherein the anti-slip structure (13) is an anti-slip pattern distributed circumferentially along the outer side wall of the cup cover (2).

* * * * *